US010229659B2

(12) United States Patent
Lyles

(10) Patent No.: US 10,229,659 B2
(45) Date of Patent: Mar. 12, 2019

(54) LOW-FRICTION BRIDGE FOR STRINGED INSTRUMENT

(71) Applicant: Intune Technologies, LLC, New York, NY (US)

(72) Inventor: Cosmos Lyles, New York, NY (US)

( * ) Notice: Subject to any disclaimer, the term of this patent is extended or adjusted under 35 U.S.C. 154(b) by 0 days.

(21) Appl. No.: 15/786,501

(22) Filed: Oct. 17, 2017

(65) Prior Publication Data

US 2018/0040311 A1 Feb. 8, 2018

Related U.S. Application Data

(63) Continuation of application No. 14/882,407, filed on Oct. 13, 2015.

(60) Provisional application No. 62/063,329, filed on Oct. 13, 2014.

(51) Int. Cl.
*G10D 3/04* (2006.01)

(52) U.S. Cl.
CPC ..... *G10D 3/04* (2013.01)

(58) Field of Classification Search
CPC ..... G10D 3/04
USPC ..... 84/307
See application file for complete search history.

(56) References Cited

U.S. PATENT DOCUMENTS

| | | | |
|---|---|---|---|
| 1,416,568 | A | 5/1922 | Mazzocco |
| 1,626,753 | A | 5/1927 | Pecina et al. |
| 2,130,248 | A | 9/1938 | Peate |
| 2,298,611 | A | 10/1942 | Bruderlin |
| 2,453,572 | A | 11/1948 | Ferrier |
| 2,605,061 | A | 7/1952 | Howe |
| 2,614,449 | A | 10/1952 | Machalek |
| 2,736,226 | A | 2/1956 | McBride |
| 2,748,644 | A | 6/1956 | McBride |
| 2,973,682 | A | 3/1961 | Fender |
| 3,136,198 | A | 6/1964 | Smith et al. |
| 3,437,001 | A | 4/1969 | Kraft |
| 3,580,525 | A | 5/1971 | Dopner |
| 3,583,272 | A | 6/1971 | Eurich |
| 3,688,631 | A | 9/1972 | Jackson |
| 4,120,462 | A | 10/1978 | Raasch et al. |
| 4,137,812 | A | 2/1979 | Franzmann |

(Continued)

FOREIGN PATENT DOCUMENTS

| | | |
|---|---|---|
| WO | WO 2006-023600 A2 | 3/2006 |
| WO | WO 2007-106600 A2 | 9/2007 |

OTHER PUBLICATIONS

Office Action on related U.S. Appl. No. 14/882,407 from USPTO dated Aug. 18, 2016.

(Continued)

*Primary Examiner* — Jianchun Qin
(74) *Attorney, Agent, or Firm* — Klein, O'Neill & Singh, LLP

(57) ABSTRACT

A low-friction bridge for a stringed musical instrument employs a roller saddle that is adapted and positioned to roll upon a race. The race includes structure to guide the roller saddle as it rolls. A musical string is seated in a circumferential groove/saddle formed in the roller saddle. As the musical string stretches or contracts the saddle rolls, and thus the musical string does not slide in the saddle. As such sliding friction is avoided in favor of rolling friction of the roller saddle rolling upon the race. One or more contact members can be biased into contact with side faces of the roller saddle.

8 Claims, 11 Drawing Sheets

(56) References Cited

U.S. PATENT DOCUMENTS

| | | | | |
|---|---|---|---|---|
| 4,426,907 | A | 1/1984 | Scholz | |
| 4,656,915 | A | 4/1987 | Osuga | |
| 4,704,935 | A | 11/1987 | Franklin | |
| 4,856,404 | A | 8/1989 | Hughes, Sr. | |
| 4,909,126 | A | 3/1990 | Skinn et al. | |
| 4,955,275 | A | 9/1990 | Gunn | |
| 5,018,700 | A | 5/1991 | Hardtke | |
| 5,040,741 | A | 8/1991 | Brown | |
| 5,095,797 | A | 3/1992 | Zacaroli | |
| 5,173,565 | A * | 12/1992 | Gunn | G10D 3/04 84/298 |
| 5,284,396 | A | 2/1994 | Masumura et al. | |
| 5,323,680 | A | 6/1994 | Miller et al. | |
| 5,377,926 | A | 1/1995 | Min | |
| 5,390,579 | A | 2/1995 | Burgon | |
| 5,477,765 | A | 12/1995 | Dietzman | |
| 5,734,117 | A | 3/1998 | Tanzella | |
| 5,886,270 | A | 3/1999 | Wynn | |
| 6,723,904 | B1 | 4/2004 | Dolan et al. | |
| 7,554,023 | B2 | 6/2009 | Tyler | |
| 7,579,536 | B2 | 8/2009 | Bonebrake | |
| 7,592,528 | B2 | 9/2009 | Lyles et al. | |
| 7,692,079 | B2 | 4/2010 | Lyles | |
| 7,855,330 | B2 | 12/2010 | Lyles et al. | |
| 8,440,897 | B1 | 5/2013 | Baxter | |
| 8,779,258 | B2 | 7/2014 | Lyles et al. | |
| 8,940,986 | B1 * | 1/2015 | Edwards | G10D 3/14 84/267 |
| 2003/0094087 | A1 | 5/2003 | Gregory | |
| 2013/0167706 | A1 * | 7/2013 | Stevens | F16D 41/00 84/312 R |
| 2013/0220099 | A1 | 8/2013 | Lyles et al. | |
| 2015/0059550 | A1 | 3/2015 | Lyles | |

OTHER PUBLICATIONS

Final Office Action on related U.S. Appl. No. 14/882,407 from USPTO dated May 17, 2017.

* cited by examiner

LOW-FRICTION BRIDGE FOR STRINGED INSTRUMENT

CROSS-REFERENCE TO RELATED APPLICATIONS

This application is a continuation of U.S. application Ser. No. 14/882,407 , filed Oct. 13, 2015, which claims priority to U.S. Provisional Application Ser. No. 62/063,329 , which was filed Oct. 13, 2014 , the entirety of both of which are hereby incorporated by reference.

This application relates to some of the subject matter concerning methods and apparatus for holding wires or strings as disclosed in Applicant's U.S. Pat. No. 7,855,440, which issued Dec. 21, 2010, and Applicant's copending U.S. application Ser. No. 14/476,619, which was filed Sep. 3, 2014, the entirety of both of which are hereby incorporated by reference.

BACKGROUND

The present disclosure relates to the field of stringed musical instruments, and more particularly to bridges for stringed musical instruments.

It is common for a stringed musical instrument such as a guitar to have a bridge separating a playing zone of the musical strings from a connection zone of the strings. The ends of the strings are held securely in the connection zone, while the playing zone is the portion of the instrument in which vibration of the strings makes music. In conventional guitars, a base or ball of a musical string is immovably secured at a flange or other connector, and the string is pulled over a bridge member, which separates the string into the playing zone and a connection zone. Over time, the musical string will stretch or contract, leading to the string possibly sliding over the bridge member. Friction forces may resist such sliding, resulting in string wear and/or inconsistent tuning.

Some guitars may secure the ball of the musical string to a string holder employing a constant tension device. Such constant tension devices may act to maintain a constant or near-constant tension in a musical string as it stretches or contracts. In such cases, the string moves as it stretches or contracts, and friction forces of the string sliding over the bridge can lessen the effectiveness of such constant tension devices, as well as causing excessive wear to the string.

Various approaches have been attempted to reduce friction in bridges. For example, some bridges may include low-friction coatings such as graphite. Another bridge design uses a rolling member as a string saddle, which rolling member rotates about an axle. Such designs can still suffer from excessive friction, and rolling saddles tend to suffer from decreased resonance and/or buzzing due to lateral movement of the rolling saddle when the string is plucked.

Additionally, in state-of-the-art electric guitars, bridge members are adjustable in a longitudinal direction in order to adjust the length of the string (known as intonation) and up and down to accommodate a user's preferred string height. Such adjustments are usually accomplished by screw-based systems. However, such systems also tend to decrease resonance.

SUMMARY

There is a need in the art for low-friction bridge having improved resonance and reduced, minimal or nonexistent buzzing. There is a further need for such a bridge that enables intonation adjustment, and which can be configured to hold the strings at various heights above the associated instrument body.

In accordance with one embodiment, the present specification provides a low-friction musical string support, comprising a roller, a first contact member and a biasing member. The roller is configured to roll within a race defined by opposing first and second race side walls, and has opposing first and second side faces that face the opposing first and second race side walls, respectively. The roller further has a circumferential groove configured to accommodate a musical string seated therein. The first contact member is interposed between the first race side wall and the first side face of the roller. The biasing member is configured to urge the first contact member into contact with the first side face of the roller. When the string moves longitudinally, the roller rolls within the race.

In one such embodiment, the roller is formed of a resonant metal, and the contact member is formed of a polymer. Another embodiment additionally comprises a second contact member interposed between the second race side wall and the second side face of the roller.

Yet another embodiment additionally comprises a second biasing member configured to urge the second contact member into contact with the second side face of the roller. In some such embodiments, the biasing member also urges the second contact member into contact with the second side face of the roller.

In a still further embodiment, the biasing member spans across both the first and second contact member. In yet another embodiment, the biasing member comprises an elastomeric band.

In another embodiment, the first contact member is positioned to engage the first side face of the roller at a point above a center of the roller.

In accordance with another embodiment, the present specification provides a kit for a bridge of a stringed musical instrument. The kit includes first, second and third sets of roller saddles, each roller saddle comprising a cylindrical body having a circumferential saddle formed therein. The saddle is adapted to accommodate a musical string seated therein. Each of the first, second and third sets of roller saddles have a plurality of identical roller saddles. The cylindrical body of the roller saddles in the first set has a first radius, the cylindrical body of the roller saddles in the second set has a second radius greater than the first radius, and the cylindrical body of the roller saddles in the third set has a third radius greater than the second radius. A race defines a rolling path of each of the roller saddles.

Another embodiment additionally comprises first and second base plates, the second base plate having a greater thickness than the first base plate, the first and second base plates configured to be selectively secured to a body of a musical instrument. In a further embodiment, the first and second base plate each define the race thereon.

In accordance with still another embodiment, the present invention provides a low-friction musical string support. The support comprises a support bearing configured to roll over a race, and a roller saddle configured to roll upon the support bearing. The roller saddle comprises a string receiver configured to receive a musical string, which musical string is held at a tension. When the string elongates, the roller saddle rotates in a first rotational direction and the support bearing rotates in a second rotational direction.

In some such embodiments, the string receiver comprises a circumferential groove, and the support bearing comprises a circumferential ridge configured to fit complementarily within the circumferential groove of the roller saddle.

In accordance with still another embodiment, the present specification discloses a string system for a stringed musical instrument comprising a bridge module and a string holder module. The string holder module comprises a string tensioner configured to maintain tension in a corresponding string within a range about a perfect tune tension. The bridge module comprises a roller saddle having a circumferential groove and a string seated in the groove. The roller saddle can roll over a base plate.

In some such embodiments, when the string moves longitudinally the roller saddle rolls so that the string does not slide over the roller saddle surface.

DESCRIPTION

The following description presents embodiments illustrating aspects of the present invention. It is to be understood that various types of musical instruments can be constructed and/or retrofitted using aspects and principles as described herein, and embodiments are not to be limited to the illustrated and/or specifically-discussed examples. Rather, additional embodiments may selectively employ various aspects and/or principles disclosed in the specification. Also, for ease of reference, embodiments are disclosed and depicted herein in the context of a four-string bass electric guitar. However, principles as discussed herein can be applied to other acoustic and electric instruments such as, for example, violins, harps, and pianos.

Figure 1:
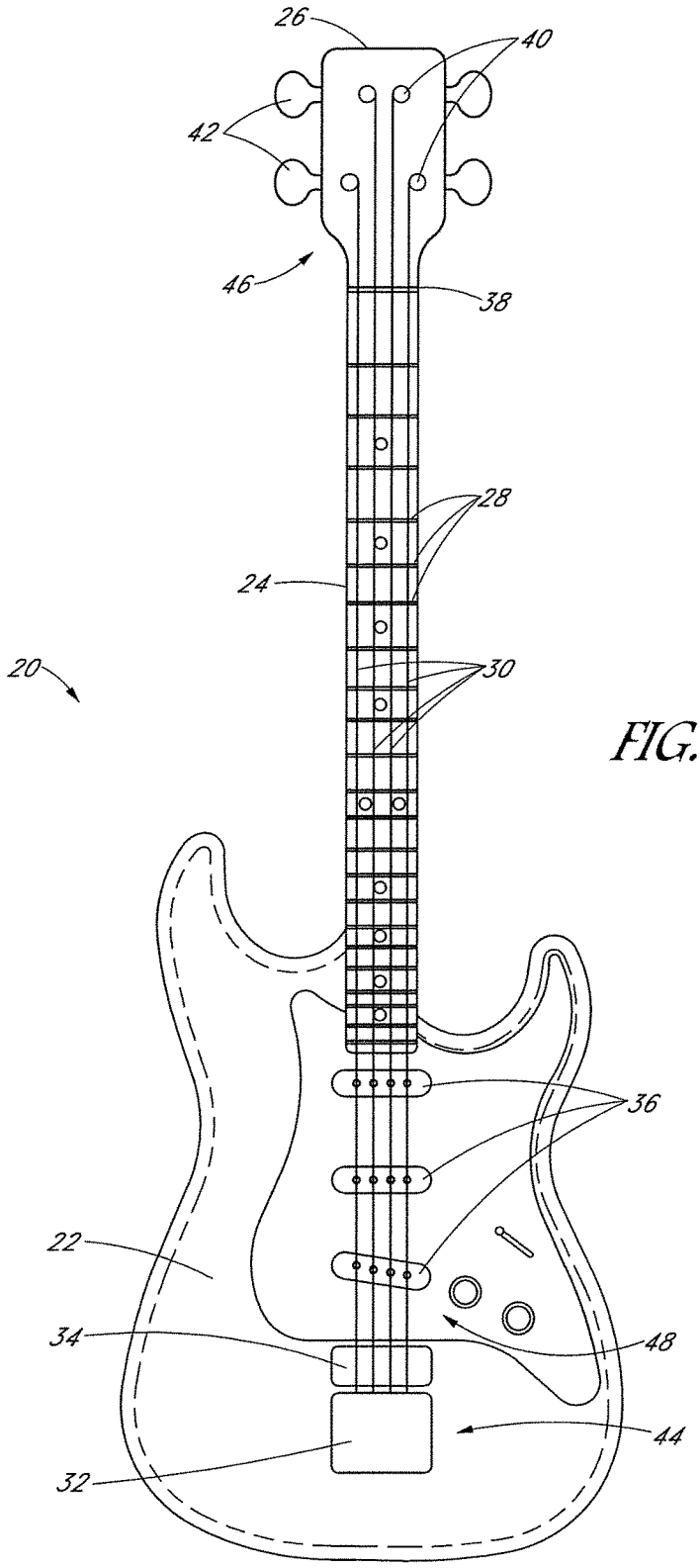
FIG. 1 is a plan view of a four-string bass electric guitar schematically incorporating a bridge module and string holder module in accordance with one embodiment.

With initial reference to FIG. 1, a guitar 20 is illustrated. The illustrated guitar 20 comprises a body 22 from which an elongated neck 24 extends, which neck extends to a head 26. As is typical with guitars, frets 28 can be provided along the neck 24. Musical strings 30 traverse the body 22, neck 24 and head 26 of the guitar 20, and preferably are held in tension. More specifically, proximal ends of the strings 30 are held securely by a string holder module 32 and then pass over a bridge module 34. Pickups 36 on the body 22 are configured to sense string vibrations above the guitar body 22. The strings 30 traverse the neck 24, extend over a head nut 38, and are each wound about an axle 40, which axle 40 preferably is controlled by turning a corresponding tuning peg 42. As with conventional guitars, by turning the tuning pegs 42, and thus also turning the axles 40, each string 30 can be tightened to an appropriate tension corresponding to a desired string tune A body string connection zone 44 is defined proximal of the bridge module 34 and a head string connection zone 46 is defined distal of the nut 38. A playing zone 48 is defined between the bridge module 34 and nut 38. String vibrations in the playing zone 48 are isolated from string vibrations in the body connection zone 44 and head connection zone 46 by the bridge module 34 and head nut 38, respectively.

Figure 2:
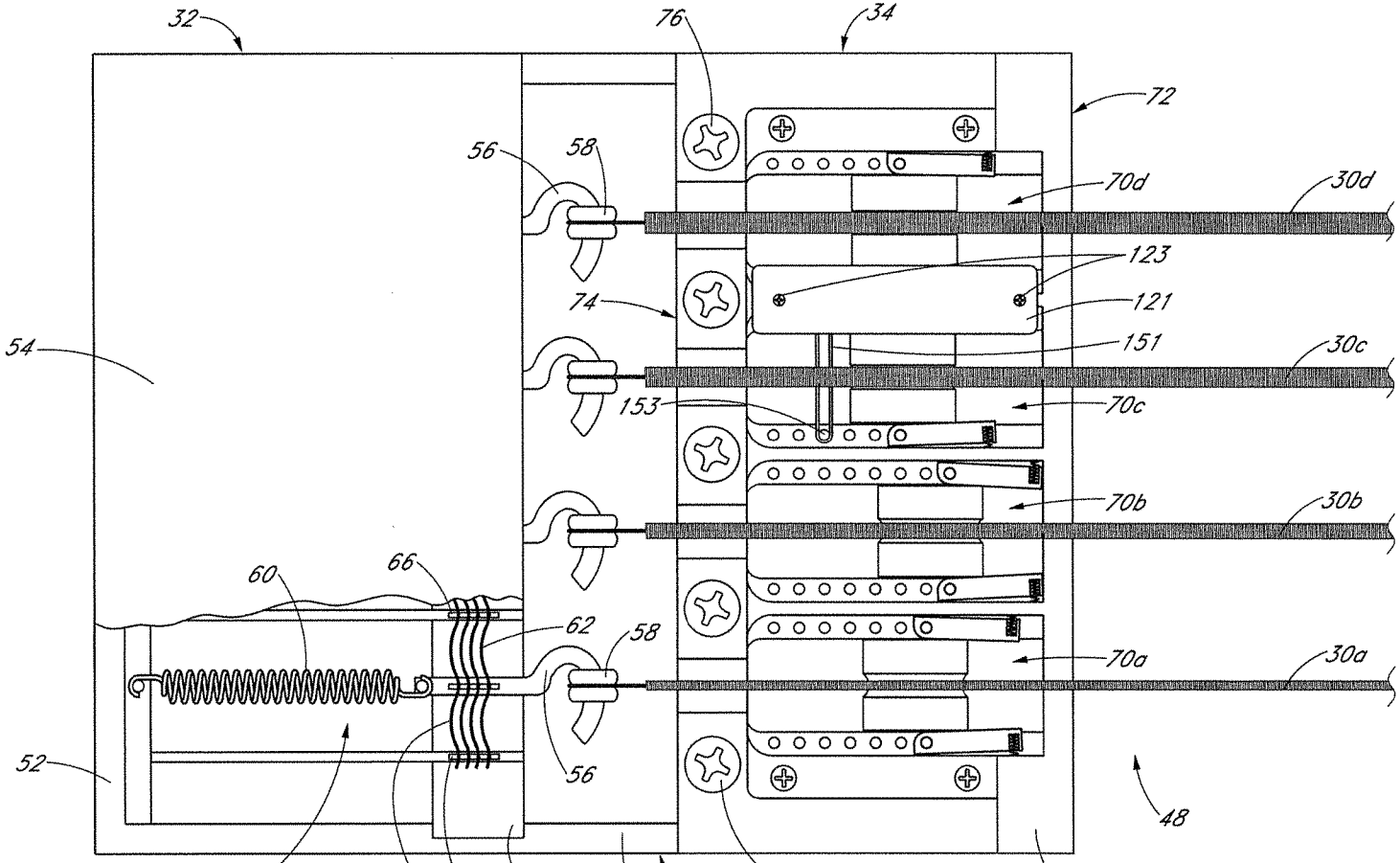
FIG. 2 is a close-up view of a bridge module and string holder module in accordance with an embodiment.

With reference next to FIG. 2, an embodiment of a bridge module 34 and string holder module 36 is shown. The illustrated string holder module 36 includes a plurality of string tensioners 50, one string tensioner 50 corresponding to each musical string 30. The illustrated string tensioner 50 preferably comprises a constant tension device such as is originally disclosed in Applicant's co-pending U.S. application Ser. No. 14/476,619, which is incorporated herein by reference in its entirety. In this embodiment, multiple string tensioners are enclosed within and supported by a string holder module frame 52. As shown in FIG. 2, a plate 54 preferably covers the string tensioners. However, FIG. 2 has a portion of the plate 54 cut away to illustrate an exemplary string tensioner 50.

In the illustrated embodiment, each string tensioner 50 comprises a connector 56 at its distal end to which a string ball 58 is attached. The string ball 58 is at the proximal end of each musical string 30, and functions to connect the string 30 to the tensioner 50. The string tensioner includes a primary spring 60 that is connected at its distal end to the connector 56 and at its proximal end to the frame 52. Preferably, the primary spring 60 is held in tension and longitudinally aligned with the string 30. As such, the primary spring 60 applies a longitudinal tension force to the attached musical string 30. In the illustrated embodiment, a plurality of secondary springs 62 which, in the illustrated embodiment, comprise thin metal sheets, are attached to the connector 56 and to a secondary frame 64. The secondary frame includes a plurality of stationary spring mounts 66 configured to hold the secondary springs 62.

As discussed above, the primary spring 60 is held in tension and correspondingly applies tension to the attached string 30. However, as the string 30 stretches and contracts over time, the primary spring 60 will correspondingly stretch or contract, thus changing the tension applied by the primary spring 60 to the string 30. The secondary springs 62 are configured to apply a force to the connector. However, only a portion of this force is directed as a force vector in a longitudinal direction. Preferably, the longitudinally-directed vector force changes as the primary spring 60 elongates and contracts. Also, the secondary springs 62 are chosen so that the variation in the longitudinal force vector generated by the secondary springs generally corresponds to the change in longitudinal force applied by the primary spring 60 so that the secondary and primary springs, taken together, apply a constant or near-constant longitudinally-directed tension force to the corresponding string 30 over a range of operation.

In such embodiments, as the string 30 stretches and contracts, the string tensioner 50 will maintain a constant or near-constant tension in the string, however, the string 30 will move. For example the position of the string ball 58 may move proximally or distally, and correspondingly the string 30 will move over the bridge 34. Excessive friction in the bridge could dilute the effectiveness of the string tensioner 50 in keeping tension in the string 30 at a constant or near-constant level.

In the illustrated embodiment, the string tensioner 50 has structure as illustrated. However, it is to be understood that other string tensioner configurations can be employed, including other embodiments of tensioners that apply a constant or near-constant force over an operational range. For example, Applicant's issued U.S. Pat. No. 7,855,330 discloses embodiments of constant tension devices that can maintain musical strings at a constant or near-constant tension in order to maintain string tune. Embodiments as disclosed in the '330 patent, closure of which is incorporated by reference in its entirety, can also be employed as a string tensioners. Still further, some string holder module embodiments may not adjust with the strings, but may more traditionally hold the string balls at a constant, fixed position. Such traditional embodiments may still benefit from the principles and aspects discussed herein.

With continued reference to FIG. 2, a bridge module 34 comprises a plurality of races 70*a-d,* each race corresponding to a corresponding string 30*a-d.* As shown, the bridge module 34 comprises a distal end 72 and a proximal end 74. A plurality of screws 76 attach the bridge module 34 to the guitar body 22. In the illustrated embodiment, the bridge module 34 and string holder module 32 share a common frame 78. In other embodiments, however, the bridge module 36 and string holder module 32 can be formed and attached to the guitar body independently of one another.

Figure 3:
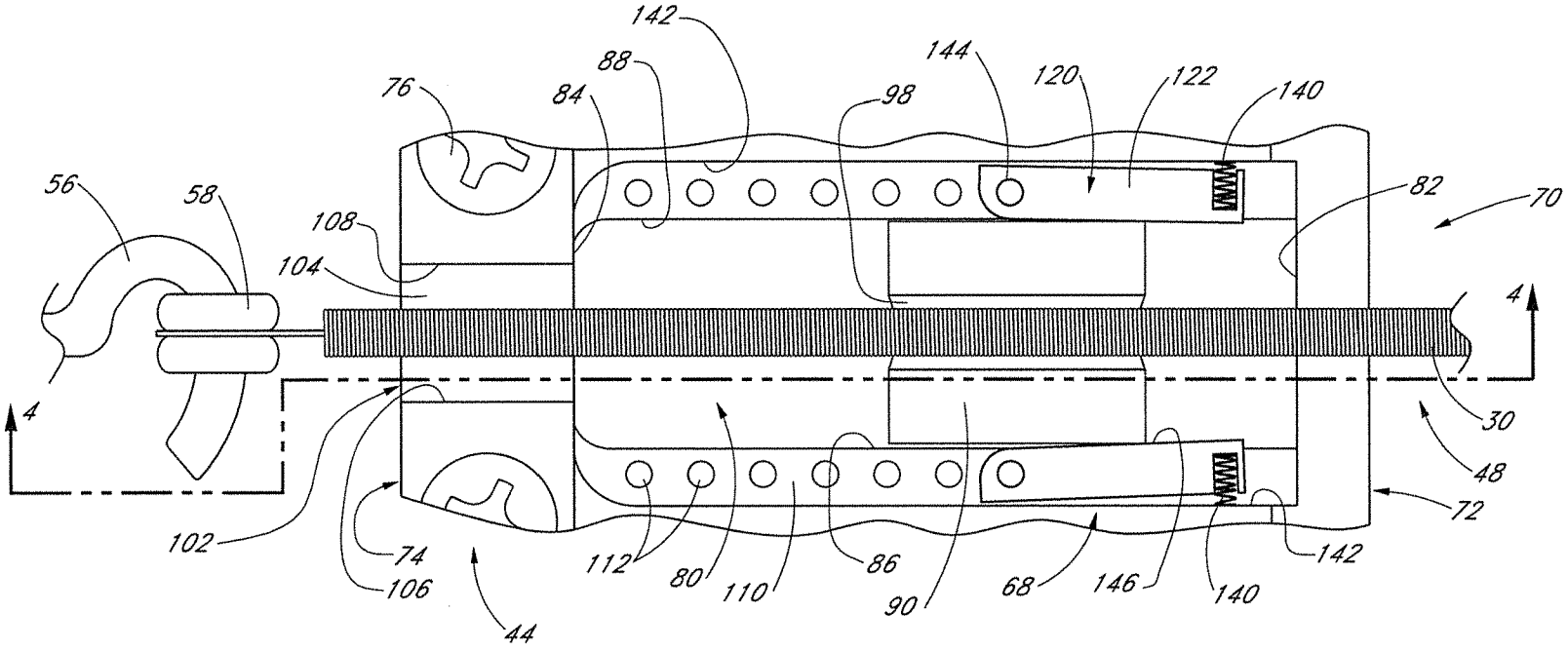
FIG. 3 is a top, plan view of a portion of the bridge module of FIG. 2.
Figure 4:
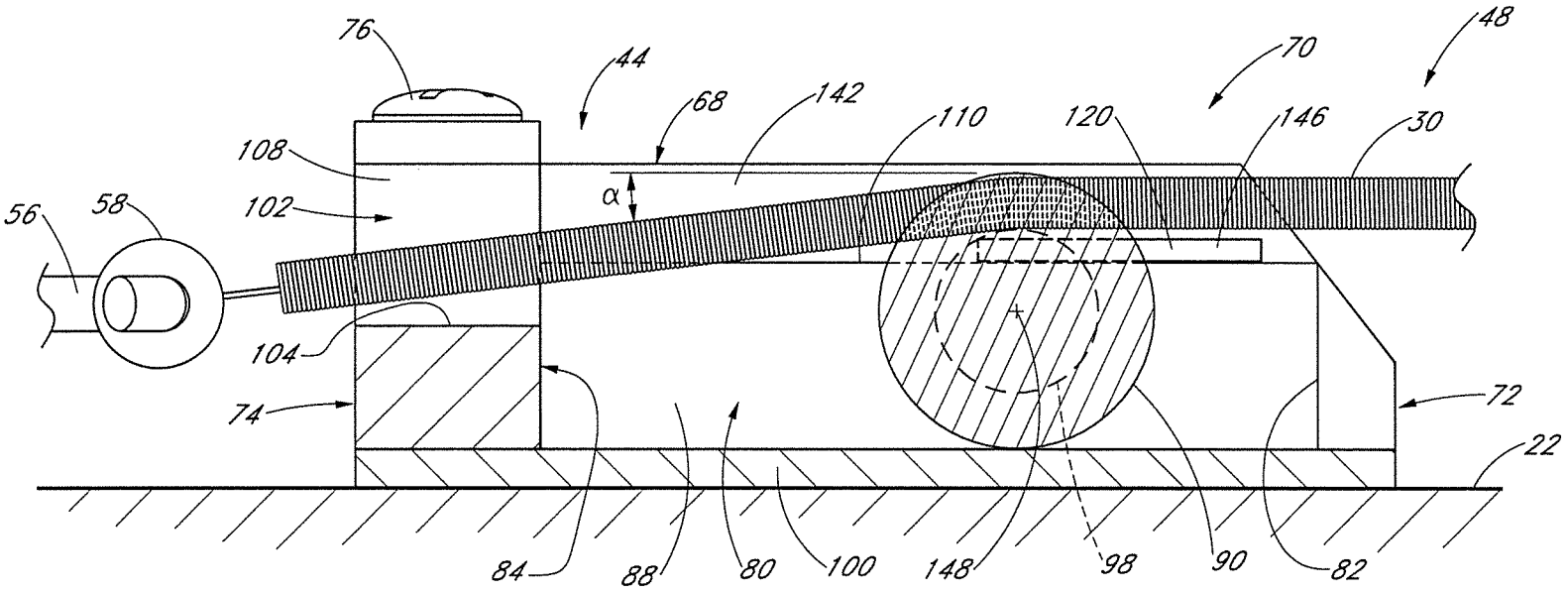
FIG. 4 is a side view taken along lines 4-4 of FIG. 3.

With reference next to FIGS. 2-4, each race 70 comprises an elongated channel 80 defined by a distal channel wall 82, proximal channel wall 84 and first and second channel side walls 86, 88. A roller saddle 90 is fit within the elongated channel 80 and is configured to roll therewithin.

Figure 5:
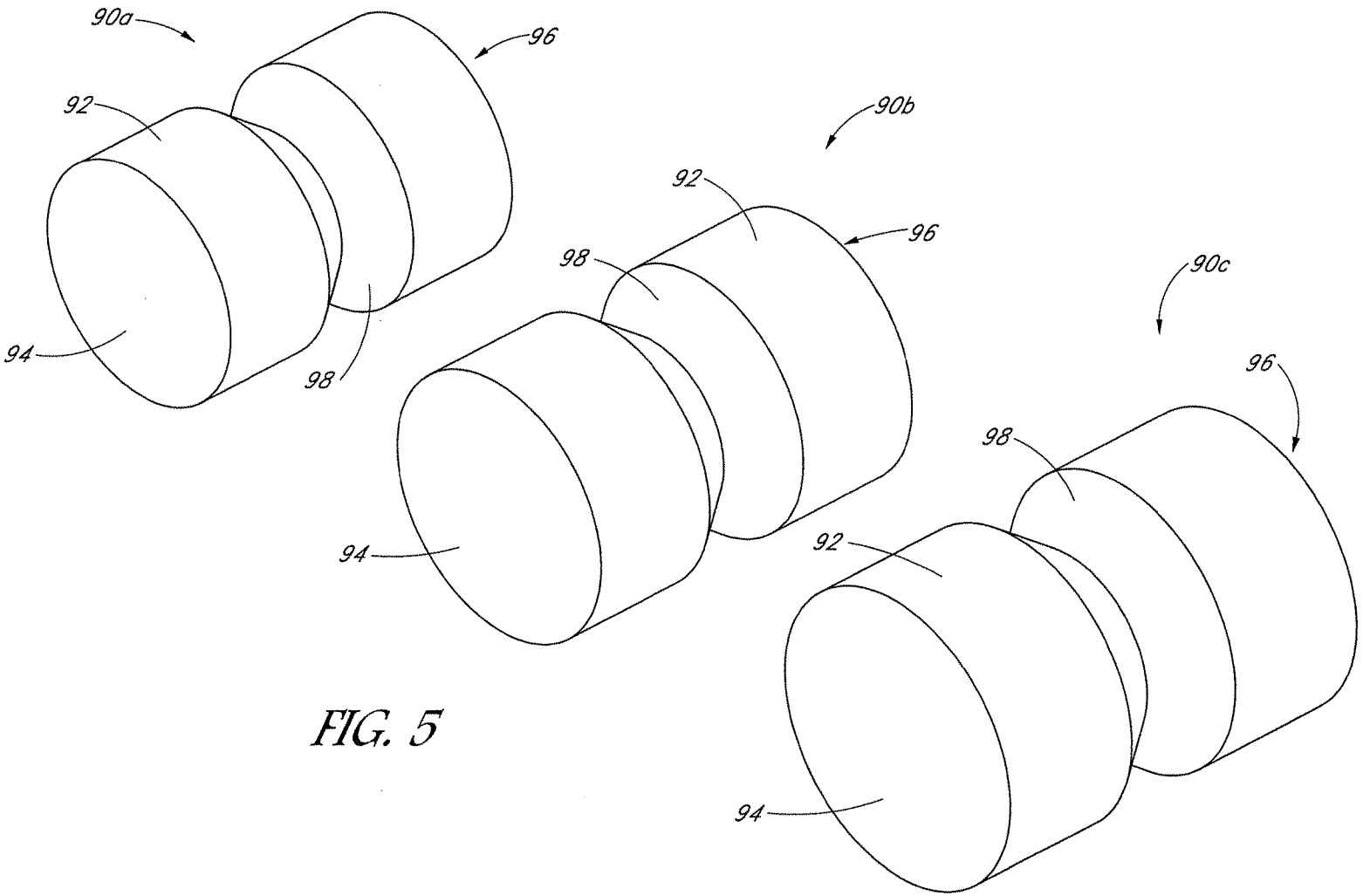
FIG. 5 shows perspective views of roller saddles having features in accordance with some embodiments.

With additional reference to FIG. 5, each roller saddle 90 comprises a cylindrical body 92 and first and second side faces 94, 96. A circumferential groove or saddle 98 is formed in the cylindrical body 92. In the illustrated embodiment, the groove is generally V-shaped. Other shapes, such as U-shaped or the like, can also be employed. Preferably, the saddle 98 is configured to receive a string 30 seated therein.

With particular reference again to FIGS. 3 and 4, the bridge module 34 preferably includes a base plate 100. The roller saddle 90 thus is configured to roll atop the base plate 100 and within the elongated channel 80. A slot 102 is formed at a proximal end of the channel and is defined by a bottom surface 104 and opposing first and second side walls 106, 108. A string 30 extends from the playing zone 48 over the distal wall 82 and is supported in the saddle 98 of the roller saddle 90. From the saddle 98, the string 30 extends proximally through the slot 102 and proximal of the bridge module 34 until the string ball 58 is attached to the tensioner connector 56. As such, in the illustrated embodiment the roller saddle 90 separates the body connection zone 44 from the playing zone 48.

Preferably, a width of the elongated channel 80 between the first and second channel side walls 86, 88 approximates a width of the roller saddle 90, but enables the roller saddle 92 role within the channel 80 unobstructed by the channel side walls 86, 88. Preferably, the roller saddle 90 rolls on the base plate 100. However, in other embodiments, the roller saddle may ride over and be supported upon the surface of the guitar body 22.

As discussed above, the string 30 is seated in the groove/saddle 98. Since the roller saddle 90 readily rolls on the base plate 100, when the string 30 expands and contracts, the roller saddle 90 will roll to accommodate such movement and the string 30 will not slide relative to the surface of the saddle 98. As such sliding friction of the string 30 over the saddle 98 is minimized or totally avoided in favor of rolling friction of the roller saddle 90 over the base plate 100, which is much less than sliding friction.

Most preferably, the roller saddle 90 is formed of a solid block of a choice vibrational material such as bronze, brass or titanium. Preferably, the base plate 100 is also formed of a choice vibrational material. As such, resonance from the vibrating string 30 is easily transferred through the roller saddle 90 and base plate 100 to the guitar body 22, and back to the string 30.

As discussed above, accomplished guitarists wish to adjust the length of each guitar string 30 in order to attain proper tuning. Such length adjustment, known as intonation, typically involves independent positioning of each bridge member to set the desired length for the corresponding guitar string. In operation, a user may first select the desired intonation location of the roller saddle 90 by placing the roller saddle within the elongated channel 80 and rolling and/or pushing it to a desired position for intonation. Once intonation is completed, and the string has been put in place and is under tension, the roller saddle can operate normally, rolling with very low friction as the string stretches or contracts. Indeed, preferably, the roller saddle experiences no sliding-based friction, and only experiences the relatively-low rolling friction.

As discussed above, in the illustrated configuration, as the string 30 stretches or contracts a given length, the roller saddle will rotate. In fact, the rotating roller saddle will translate longitudinally to a lesser extent that the string translates longitudinally. As such, the roller saddle configuration dampens the effect string translation may have on intonation positions, and the saddle 98 translates less than does the string.

A user may also wish to adjust the height of the strings 30 relative to the guitar body 22. To this end, preferably a base plate 100 is selected having a thickness that will place the strings 30 at or near a desired height above the guitar body 22. With additional reference to FIG. 5, a user can then select a desired roller saddle size. More specifically, a kit may be provided, which kit may include the bridge module 34 and multiple sets of roller saddles, each set of roller saddles having a different radius. For example, with particular reference to FIG. 5, a first set of roller saddles 90*a* has a first radius R1, a second set of roller saddles 90*b* has a second radius R2 that is nominally greater than the first radius R1, and a third set of roller saddles 90*c* have a third radius R3 that is nominally greater than the second radius R2. The user can select the set of roller saddles having a radius corresponding to the desired height. The user can also select different sizes of rollers for particular strings so that each string can be at a desired height. In some embodiments, the kit may also or instead include multiple base plates, each having a different thickness. Thus by selecting a particular base plate and/or a particular set of roller saddles, a user may configure his bridge module 34 to have a desired height.

It is to be understood that, in other embodiments, height adjustment can be accomplished by other structures. For example, the bridge module may include screws that adjust the height of the entire module relative to the guitar body.

With particular reference again to FIGS. 2-4, as discussed above, the roller saddle 90 fits complementarily within the elongated channel 80 so that it can roll therein. During use, vibration in a plucked string 30 is communicated to the corresponding roller saddle 90. Such vibration includes a side-to-side component that carries the risk of generating a buzzing sound with the channel.

As shown, each race 70 additionally includes a pair of support surfaces 110 atop each channel side wall 86, 88. Spaced apart adjustment holes 112 preferably are formed through each support surface 110.

Figure 6:
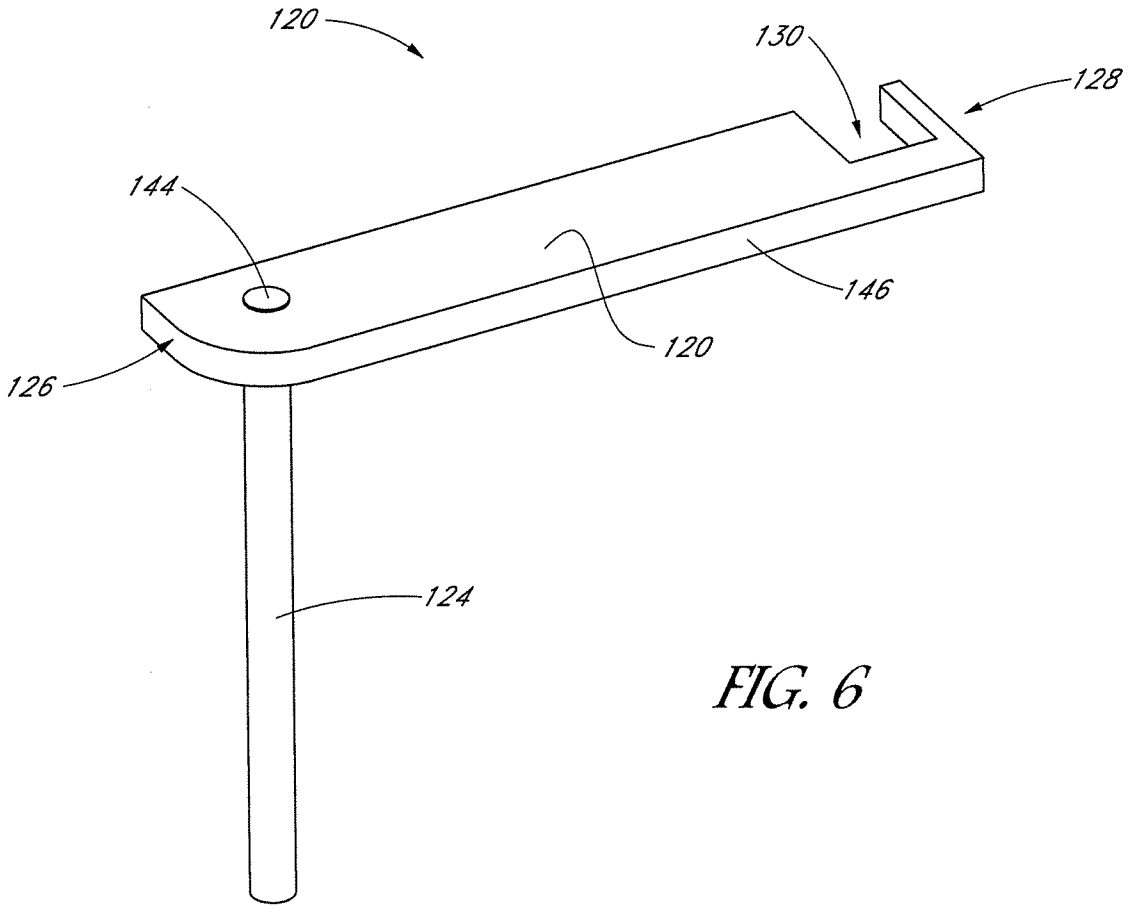
FIG. 6 is a perspective view of a contact member for use in the bridge module embodiment of FIGS. 2-4.

With additional reference to FIG. 6, a contact member 120 comprises an elongated bar 122 having a proximal end 126 and a distal end 128. The elongated bar 122 is connected to an elongated pin 124 near a proximal end 126 of the bar 122. A receiver 130 is formed as a cavity at or adjacent a distal end 128 of the bar.

With continued reference again to FIGS. 3 and 4, the pin 124 of the contact member 120 fits into any of the adjustment holes 112. Preferably, and as shown in FIG. 3, the contact member 120 is placed so that the proximal end 126 of the contact member is at or adjacent a side surface 94, 96 of the roller saddle 90, and the distal end 128 of the elongated bar 122 is positioned distal of the roller saddle 90.

In the illustrated embodiment, a biasing member 140, such as a small coil spring, extends into each receiver 130 and engages a race side wall 142 so as to urge the elongated bar 122 to rotate about a pivot point 144, and thus bias a contact surface 146 of the contact member 120 against the corresponding side face of the roller saddle 90.

In the embodiment illustrated in FIG. 3, each race 70 includes opposing first and second contact members 120 that are mirror images of one another and which engage opposing first and second side faces 94, 96 of the roller saddle 90.

With additional reference to FIG. 4, preferably each elongated bar 122 of each contact member 120 is positioned above a rolling axis 148 of the roller saddle 90 and is at or near the level of the corresponding string 30. In some embodiments, the contact member 120 is slightly below the corresponding string 30; in other embodiments the contact member 120 is slightly above the corresponding string 30; and in further embodiments the contact member 120 is at least partially aligned with or at the same height as the corresponding string 30. Preferably, the corresponding roller saddle 90 is squeezed between the opposing contact members 120 with a biasing force in the range of up to about 4 pounds, more preferably between 0.5 and 3 pounds, and most preferably about 1 pound. As such, side-to-side vibrations that would tend to cause buzzing are dampened or prevented from causing buzzing as a string is plucked.

The user can change the position of the contact members 120 by pulling upward on the elongated bar 122 so that the pin 124 is removed from its associated hole 112. The user can then insert the pin 124 into another one of the holes 112 as desired. Preferably, the contact members 120 on opposite sides of the channel 80 are inserted into symmetrically aligned holes 112 so as to exert a symmetrical biasing force on the associated roller saddle 90. In additional embodiments, a detent structure can be provided on the pin 124 or holes 112 so that the pins 124 do not slide out of holes 112 unintentionally.

In some embodiments, a cover can be attached atop the support surface 110 to prevent the contact members 120 from falling out of the holes. With reference again to FIG. 2, such a cover 121 is shown placed atop the frame 68 and secured with screws 123 after contact members 120 have been positioned as desired. The cover 121 prevents the contact members 120 from sliding out of the holes 112.

In the illustrated embodiment, the elongated bars 122 rest upon support surface 110. In additional embodiments, one or more of the contact members can include a pin that is longer than the corresponding holes 112 so that when the pin is inserted into the hole the elongated bar 122 will be spaced from the support surface 110.

In the illustrated embodiment, the contact members 120 are positioned relative to the associated roller saddle 90 so that the pivot point 144 is near a center of the roller saddle and most preferably proximal of a center of the roller saddle 90, while the distal end 128 of the elongated bar 122 is positioned distal of the roller saddle 90. As such, the elongated bar 122 pivots inwardly a small amount to take up play that may exist between the side faces 94, 96 of the roller saddle 90 and the channel side walls 86, 88 in order to minimize or prevent buzzing.

In the illustrated embodiment, each of the elongated bar 122 on opposite sides of the channel pivot inwardly. In additional embodiments, the elongated bar 122 on only one of the sides may pivot, while the opposing elongated bar remains stationary. In still further embodiments, only a single contact member is employed, biasing the roller saddle from only one side of the channel. Preferably, the opposing channel wall can be lined with a low-friction material, such as Teflon-infused Delrin. The contact member thus biases the roller saddle into contact with the low-friction material lining the channel wall, thus minimizing or eliminating buzzing during operation.

With particular reference to FIG. 4, the string ball 58 attaches to the connector 56 at a point lower than, or closer to the guitar body than, the position at which the string 30 is supported by the saddle 98. In this arrangement the string 30 exerts a downwardly-directed force on the roller saddle 90, which force helps keep the string 30 and roller saddle 90 in place and also keeps the string 30 firmly engaged with the saddle 98 so that any vibrations in the string 30 in the body connection zone 44 are kept separate from string vibrations in the playing 48.

A break angle $\alpha$ is defined as the angle between the string 30 proximal of the saddle 98 and the string 30 distal of the saddle 98. Notwithstanding the benefits of the force exerted by the string 30 onto the roller saddle 90 by virtue of the break angle $\alpha$, because of the break angle $\alpha$, a longitudinally-directed vector force exerted by the string 30 tends to urge the roller saddle 90 longitudinally in a distal direction. Of course, a friction force between the roller saddle 90 and the base plate 100 provides some resistance against the longitudinally-directed break angle vector force. However, there is a risk that, when the string 30 and roller saddle 90 are vibrating, the longitudinally-directed break angle vector force may cause the roller saddle 90 to slide distally over the base plate 100, possibly moving the roller saddle 90 out of the selected intonation position. However, the biasing force exerted by the opposing contact members 120 also exerts a longitudinally-directed vector force component directed proximally in opposition to the break angle vector force, and thus resists the break angle vector force.

Additionally, if the string 30 is de-tensioned, such as by a string breaking, the biasing force exerted by the opposing contact members 120 will tend to hold the roller saddle 90 in its position. Thus, the user will not have to start from scratch in finding and setting the proper intonation upon restringing the guitar 20. Also, the roller saddle 90 will tend not to fall out of the channel 80 upon de-tensioning of the corresponding string 30 because it is held in place by the contact members 120.

Figure 7:
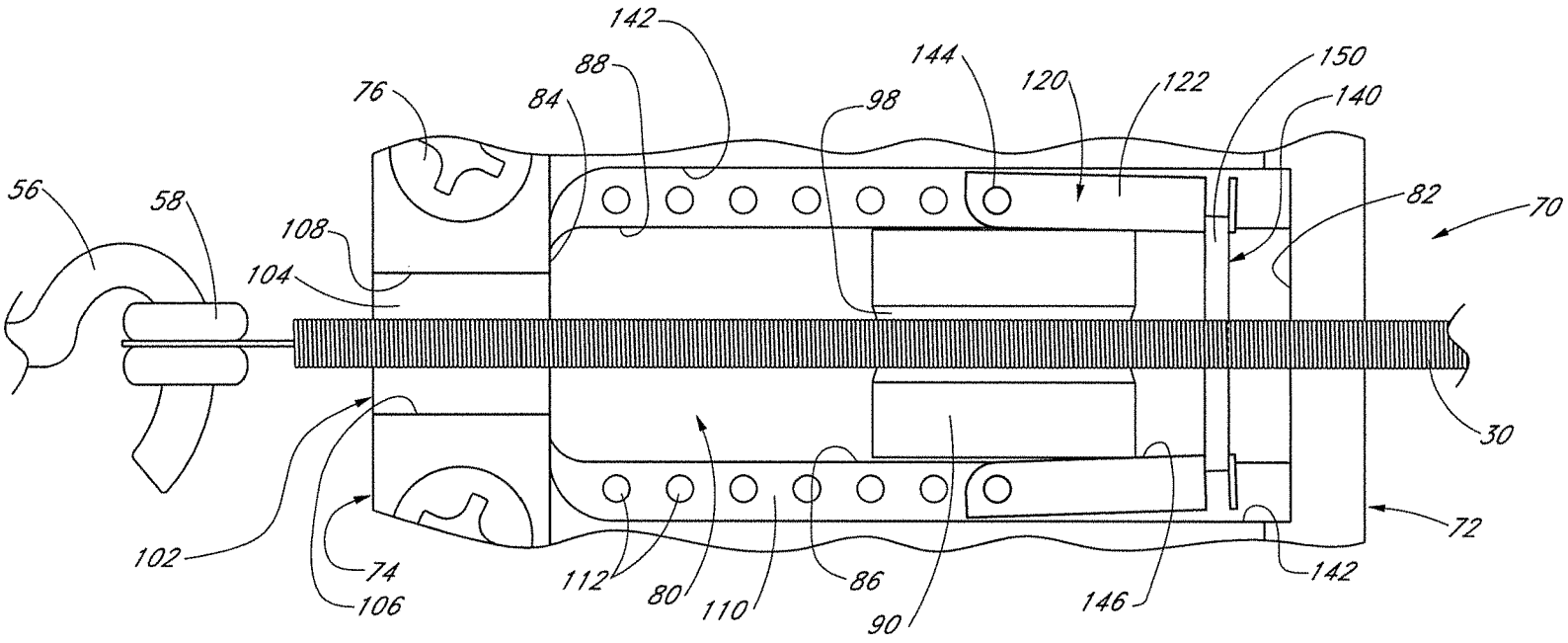
FIG. 7 is a top, plan view of a portion of another embodiment of a bridge assembly.

With reference next to FIG. 7, another embodiment is illustrated in which the biasing member 144 of the contact members 120 comprises an elastic band 150 that extends between the receivers 130 of the opposing contact members 120. Preferably, the elastic band 150 is selected to have a relaxed state somewhat smaller than the distance between opposing contact members 120 so that it is stretched in order to be received in opposing receivers 130 so as to exert a proper biasing force when connected. In additional embodiments, a plurality of sets of elastic bands 150, each set being configured to apply a different biasing force when attached to opposing receivers 130, can be included in a kit to enable the user to select a preferred biasing force for the contact members 120.

With reference again to FIG. 2, in some embodiments a second elastic band 151 can be stretched across the channel 80 proximal of the roller saddle 90. In such embodiments, secondary pins 153 can be placed in holes 112 on opposing sides of the channel, and the second elastic band 151 can be stretched across the secondary pins 153 to prevent the roller saddle 90 from rolling or sliding excessively proximally during use. In other embodiments, the second elastic band 151 can be placed so as to be in actual contact with the roller saddle.

In a preferred embodiment, the contact members 120 are constructed of a low friction material so that even though the contact members are exerting a biasing force on the side faces 94, 96 of the roller saddle 90, the roller saddle can still roll with minimal friction being exerted by the contact members 120. In one preferred embodiment, the elongated bars 122 are formed of a Teflon-infused Delrin material having a very low coefficient of friction, such as within a range of less than about 0.2, and more preferably between about 0.07-0.14 so that, when combined with the biasing force, there will be less than 10 cents of change in aural tone when the string is loaded at about 30 pounds of tension. In another embodiment, the elongated bars 122 are formed of a choice vibrational material such as is used for the roller saddle.

In the embodiments illustrated herein and discussed above, the contact members 120 are configured to pivot while exerting a biasing force on the side faces of the roller saddle. Additional embodiments may employ different structure to exert a biasing force on one or more side faces of the roller saddle. For example, in another embodiment the contact member can comprise an elongate bar that traverses all or much of the length of the channel, and is biased inwardly so as to be biased inwardly against a side face of the roller saddle in any position of the roller saddle along the length of the channel. Such biasing can be provided by springs such as coil springs, torsion springs, flat springs, leaf springs or the like, or by other materials such as elastomers in compression or tension.

Figure 8B:
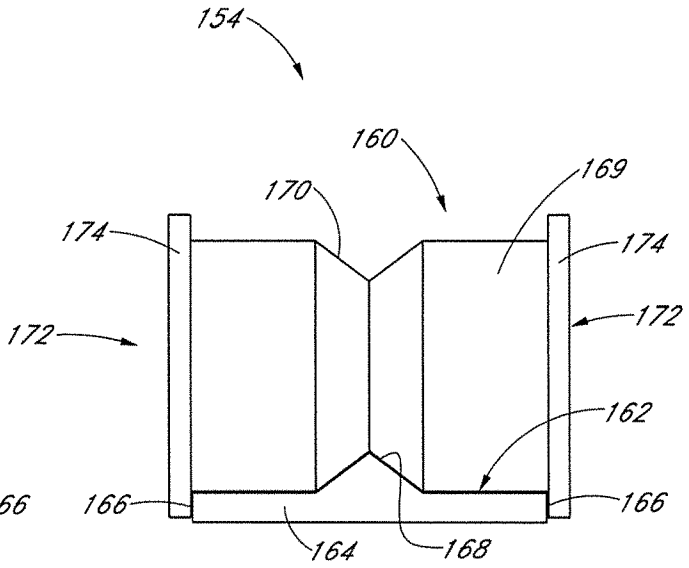
FIG. 8B is a front plan view of the embodiment of FIG. 8A.
Figure 8A:
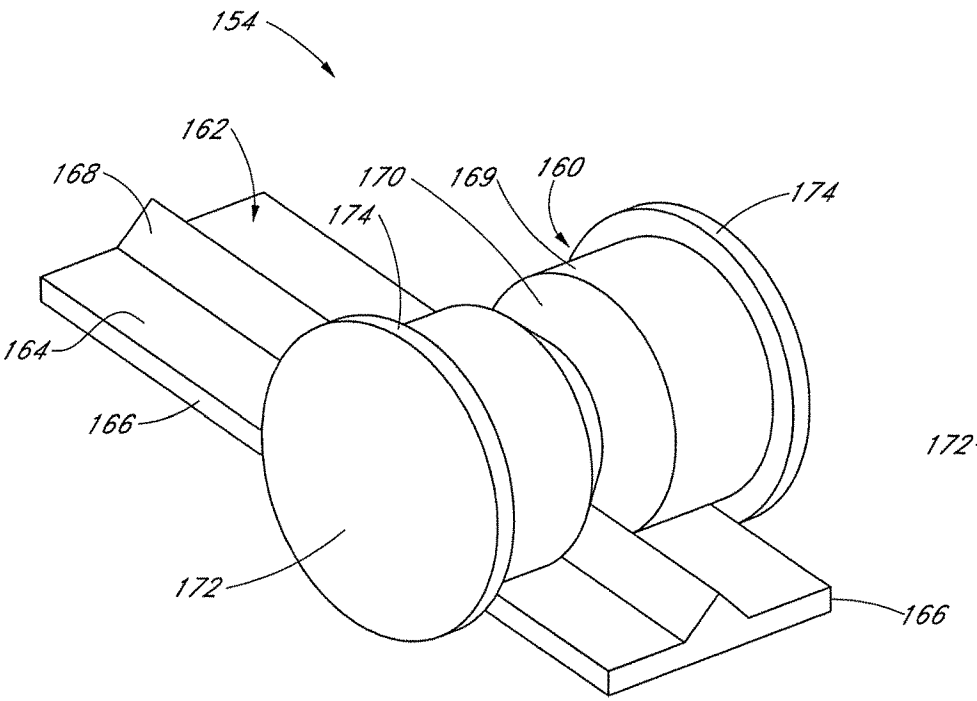
FIG. 8A is a perspective view of another embodiment of a bridge assembly.

With reference next to FIGS. 8A and B, another embodiment of a bridge assembly 154 comprises a roller saddle 160 to roll over a race 162. The race 162 comprises an elongated base plate 164 having opposing side edges 166 and an elongated ridge 168 extending generally centrally along the race 162. In the illustrated embodiment, the elongated ridge 168 has a generally upside-down V shape. The roller saddle 160 comprises a cylindrical body 169 and a circumferential groove/saddle 170 that is configured to receive a string seated 30 therewithin. Preferably, the groove/saddle 170 has a shape complementary to the elongated ridge 168 so that the roller saddle 160 receives the ridge 160 therein and is precisely guided as it rolls along the race 162.

The illustrated roller saddle 160 also comprises side faces 172 and side ridges 174 adjacent the side faces 172. The illustrated side ridges 174 have a diameter greater than the adjacent cylindrical body 169 and preferably are placed so as to hang over the side edges 166 of the race 162, also to help align the roller saddle 160 as the cylindrical body 169 rolls over the race 162.

It is to be understood that, in additional embodiments, the roller saddle 160 may not include the side ridges 174, so that the cylindrical body 169 is guided only by the saddle 170 being engaged with the elongated ridge 168 or, alternatively, the race 162 may not include the ridge 168 so that the cylindrical body 169 is guided only by the side ridges 174 being aligned with the side edges 166 when rolling over the race 162.

Figure 9:
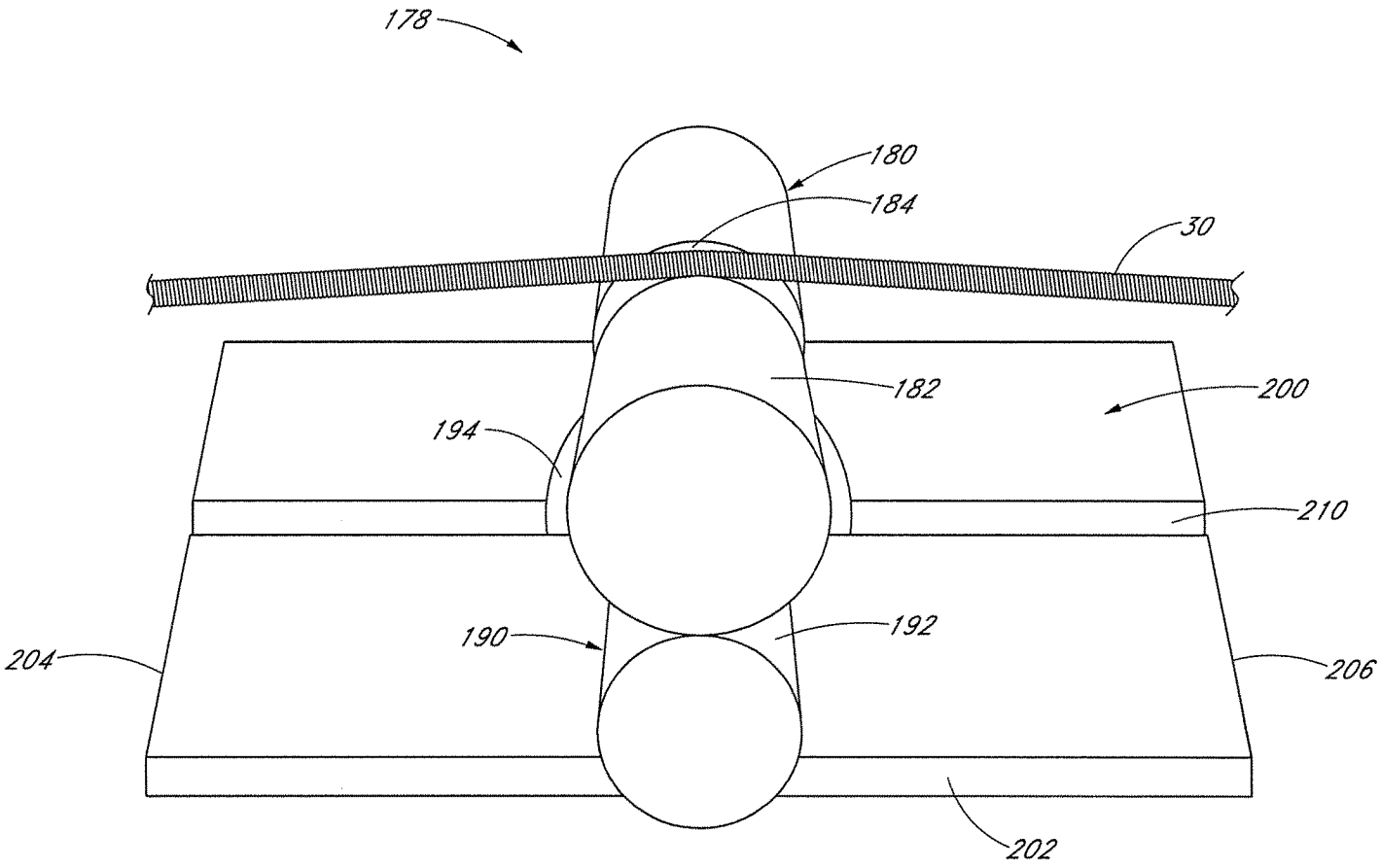
FIG. 9 is a perspective view of another embodiment of a bridge assembly.
Figure 10:
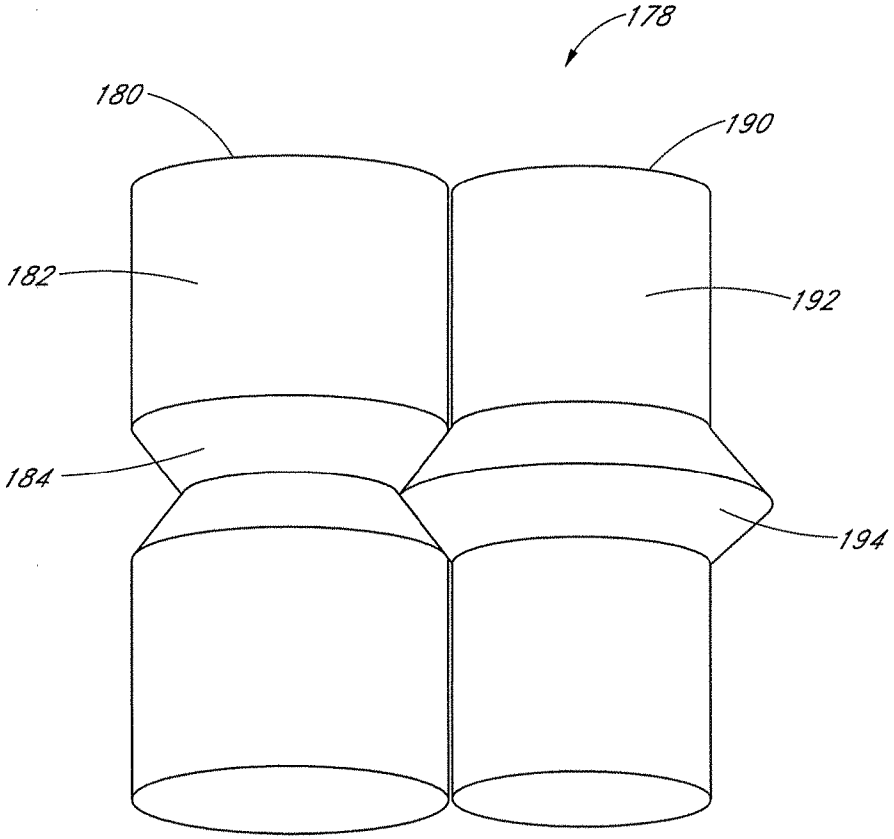
FIG. 10 is a top, plan view of a roller saddle and support bearing of the embodiment of FIG. 9.

With reference next to FIGS. 9-11, yet another embodiment of a bridge assembly 178 comprises a roller saddle 180 that comprises a cylindrical body 182 having a circumferential groove/saddle 184 formed therein. In the illustrated embodiment, the groove/saddle 184 is generally V-shaped, and is configured to receive a musical string 30 seated therewithin. A support bearing 190 also comprises a cylindrical body 192, which has a circumferential ridge 194 extending therefrom. Preferably, the circumferential ridge 194 is shaped complementarily to the groove/saddle 184 so that the ridge 194 fits within the groove/saddle 184.

A race 200 comprises an elongated base plate 202 having a proximal end 204 and a distal end 206. An elongated groove 210 is formed along the length of the elongated base plate 202. The groove 210 preferably is shaped generally the same as the groove/saddle 184 and complementary to the circumferential ridge 194 of the support bearing 190 so that the support bearing 190 rolls upon the base plate 202 with the ridge 194 received in the elongated groove 210, which guides the support bearing 190.

As shown in FIGS. 9-11 the support bearing 190 rests and rolls upon the base plate 202 with the ridge 194 received in the elongated groove 210, and the roller saddle 180 rests and rolls upon the support bearing 190 with the ridge 194 received in the groove/saddle 184. A musical string 30 is also seated in the saddle 184. The string 30 is arranged to have a break angle proximal of the roller saddle 180, and the string 30 thus exerts a force tending to keep the roller saddle 180, support bearing 190 and base plate 202 engaged with one another.

As the string 30 stretches or contracts, portions of the string at the roller saddle 180 will translate distally or proximally. In the illustrated embodiment, the string 30 will not need to be slid over the saddle surface during such translation. Instead, the roller saddle will rotate to accommodate such translation.

Figure 11A:
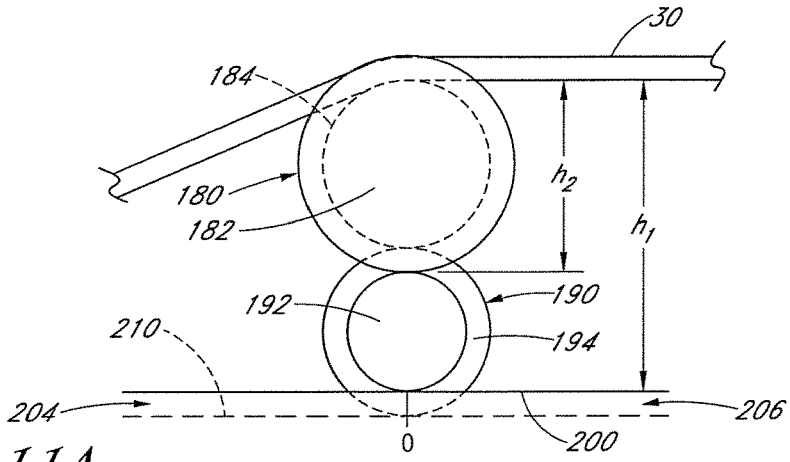
FIG. 11A is a schematic side view of the embodiment of FIG. 9.
Figure 11B:
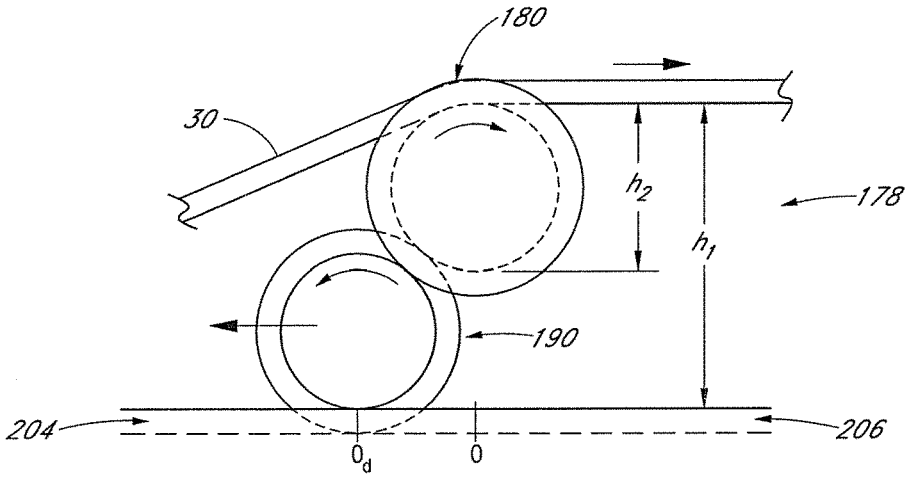
FIG. 11B is a schematic side view of the embodiment of FIG. 9 in a first position.
Figure 11C:
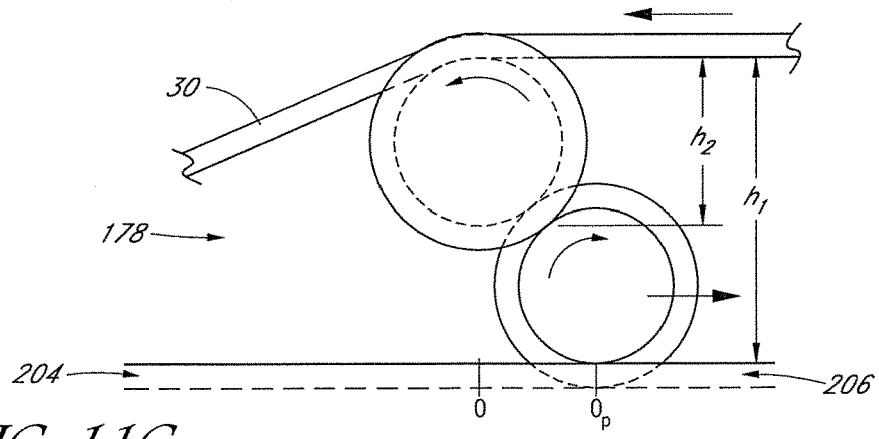
FIG. 11C is a schematic side view of the embodiment of FIG. 9 in a second position.

As best shown in FIGS. 11A-C, as the string translates distally (see FIG. 11B), the roller saddle 180 will rotate clockwise. However, the support bearing 190 will in turn rotate counter-clockwise, and will translate proximally relative to the roller saddle 180 rolling over the race 200. As such, the groove 184 of the roller saddle 180, at which the string is seated, substantially does not translate, but instead simply rolls over the support bearing 190, which support bearing 190 does in fact translate (proximally, in this example). Schematically, this operation is illustrated as moving from the arrangement in FIG. 11A to the arrangement in FIG. 11B. The benefit of this interaction is to reduce (or eliminate) any change in the playable length of the string as the roller saddle 180 rolls with the change of string length. As such, intonation position is preserved even as the string translates longitudinally A similar, but oppositely directed, effect will occur when the string 30 translates proximally, which is represented schematically as moving from the arrangement in FIG. 11A to the arrangement in FIG. 11C.

Notably, in guitars, the total range of translation of the musical string 30 during operation and even during stretching and contracting of the string 30 can be relatively low, such as less than about 0.12 inches, more preferably less than about 0.08 inches, and most preferably about 0.06 inches. Thus, it is anticipated that embodiments applied to guitars have operational lengths of longitudinal string translation within or approximating these ranges.

As depicted in FIG. 11A-C, the roller saddle 180 rotates over the support bearing 190, while the support bearing 190 translates as it rotates upon the race 200. As such, a distance h2 between the saddle 184 and the point at which the roller saddle cylindrical body 182 contacts the support bearing cylindrical body 192 decreases moving from the arrangement in FIG. 11A to the arrangement in FIG. 11B, as does the total height h1 of the saddle 184 relative to the race surface (or the surface of the associated instrument). In one embodiment, if the support bearing 190 has a diameter of about 0.25 inches, the saddle 184 of the roller saddle 180 (and thus the string 30) will change in height h1 by a maximum of about 0.007 inch. In some embodiments and applications, this change in height may be acceptable.

In additional embodiments, the roller saddle, the support bearing, and/or the race can be shaped to define one or more cams that can cancel out or reduce the change in height h1. For example, although in some embodiments the roller saddle and support bearing have been described as cylindrical, and the race as flat, in other embodiments one, the other, or both of the roller saddle and support bearing may not be cylindrical, and/or the race can be inclined or curved. As noted above, the range of translation of the string can be quite small, preferably spanning only a portion of the circumferential surface of either bearing.

In one embodiment, the groove/saddle of the roller saddle can be cammed so that a vertical distance h2 between the point at which the string contacts the saddle surface and the point at which the roller saddle contacts the support bearing is smallest at a central portion of the range of motion, and increases on both sides, thus maintaining the string height h1 at or near a constant value. Similarly, in other embodiments the upper and or lower surface of the support bearing can be configured so that the point at which the string contacts the saddle surface remains at a substantially constant height from one end of the operational range of rotation/translation to the other. The race can also be curved, for example having a concave curvature, to counteract height change during translation of the support bearing. In still other embodiments, combinations of such camming structures can be employed.

In still further embodiments, the race can be configured so that the position of the race can be manually translated proximally or distally by the user during tuning so that the string can be centered in the range of operation when at a desired perfect tune position or tension.

The embodiments discussed above have disclosed structures with substantial specificity. This has provided a good context for disclosing and discussing inventive subject matter. However, it is to be understood that other embodiments may employ different specific structural shapes and interactions.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. For example, the roller saddles and races described in connection with FIGS. 2-4 can also incorporate features of the roller saddles and races described in connection with FIGS. 8A & B or 9-11. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A low-friction musical string support, comprising:

an elongated race defining a first race surface;

a roller saddle configured to roll about a rolling axis and upon the elongated race, the roller saddle having a first arcuate rolling surface and an arcuate saddle portion, the first arcuate rolling surface being oblique to the rolling axis;

the first race surface being complementary to the first arcuate rolling surface so that the first arcuate rolling surface engages and is supported by the first race surface;

the first arcuate rolling surface and first race surface adapted so that the first arcuate rolling surface rolls upon the first race surface, and as the first arcuate rolling surface rolls upon the first race surface, the rolling axis of the roller saddle translates longitudinally relative to the elongated race;

the arcuate saddle portion having an arcuate groove configured to accommodate a musical string seated therein upon a groove inner surface;

wherein when the musical string moves longitudinally, the first arcuate rolling surface rolls upon the first race surface and the roller saddle rotates about the rolling axis.

2. A low-friction musical string support as in claim 1, wherein the first arcuate rolling surface extends about the entire circumference of the rolling axis.

3. A low-friction musical string support as in claim 1, wherein the guide member of the elongated race remains adjacent the guide face of the roller saddle when the roller saddle translates longitudinally relative to the elongated race.

4. A low-friction musical string support as in claim 1, wherein the roller saddle additionally comprises a second arcuate rolling surface, and the elongated race comprises a second race surface that is complementary to the second arcuate rolling surface so that the second arcuate rolling surfaces engages and is supported by the second race surface.

5. A low-friction musical string support as in claim 4, wherein the second arcuate rolling surface is oblique relative to the rolling axis.

6. A low-friction musical string support as in claim 5, wherein the first and second arcuate rolling surfaces are disposed at equal but opposite oblique angles relative to the rolling axis.

7. A low-friction musical string support as in claim 6, wherein the first and second arcuate rolling surfaces are adapted to be simultaneously supported and roll upon the first and second race surfaces, respectively.

8. A low-friction musical string support as in claim 7, wherein the first and second race surfaces are flat.

* * * * *